US012408813B2

(12) United States Patent
Dettmer

(10) Patent No.: US 12,408,813 B2
(45) Date of Patent: Sep. 9, 2025

(54) CUTLERY RACK FOR A DISHWASHER

(71) Applicant: Miele & Cie. KG, Gütersloh (DE)

(72) Inventor: Martin Dettmer, Bielefeld (DE)

(73) Assignee: MIELE & CIE. KG, Gütersloh (DE)

( * ) Notice: Subject to any disclaimer, the term of this patent is extended or adjusted under 35 U.S.C. 154(b) by 0 days.

(21) Appl. No.: 18/868,794

(22) PCT Filed: Jun. 19, 2023

(86) PCT No.: PCT/EP2023/066346

§ 371 (c)(1),
(2) Date: Nov. 25, 2024

(87) PCT Pub. No.: WO2024/002729

PCT Pub. Date: Jan. 4, 2024

(65) Prior Publication Data

US 2025/0255457 A1 Aug. 14, 2025

(30) Foreign Application Priority Data

Jun. 28, 2022 (BE) ..... 2022/5514

(51) Int. Cl.
*A47L 15/50* (2006.01)

(52) U.S. Cl.
CPC ..... *A47L 15/502* (2013.01); *A47L 15/505* (2013.01); *A47L 15/507* (2013.01)

(58) Field of Classification Search
None
See application file for complete search history.

(56) References Cited

U.S. PATENT DOCUMENTS

| | | | |
|---|---|---|---|
| 9,265,404 | B2 | 2/2016 | Fey et al. |
| 2022/0133124 | A1 | 5/2022 | Kim et al. |

FOREIGN PATENT DOCUMENTS

| | | | |
|---|---|---|---|
| CN | 209404715 | U | 9/2019 |
| DE | 102011080698 | A1 | 2/2013 |
| DE | 102011053497 | A1 | 3/2013 |
| EP | 3025628 | A1 | 6/2016 |
| EP | 3409182 | A1 | 12/2018 |

*Primary Examiner* — Rita P Adhlakha

(74) *Attorney, Agent, or Firm* — Leydig, Voit & Mayer, Ltd.

(57) ABSTRACT

A cutlery rack for a dishwasher includes: a rack body, which is mounted such that the rack body is pullable out of a washing chamber of the dishwasher in a pull-out direction and which provides a cutlery insert for receiving pieces of cutlery, the cutlery insert having, for separately holding pieces of cutlery oriented transversely to the pull-out direction, a first stud row and a second stud row, which runs parallel to and is spaced apart from the first stud row, each stud row having a plurality of studs disposed one behind another in the pull-out direction, and in each stud row, adjacent studs are mutually spaced apart such that, in each case, an intermediate space is formed. Two adjacent studs of the first stud row and two adjacent studs of the second stud row are provided by a common support element.

13 Claims, 9 Drawing Sheets

CUTLERY RACK FOR A DISHWASHER

CROSS-REFERENCE TO PRIOR APPLICATIONS

This application is a U.S. National Phase application under 35 U.S.C. § 371 of International Application No. PCT/EP2023/066346, filed on Jun. 19, 2023, and claims benefit to Belgian Patent Application No. BE2022/5514, filed on Jun. 28, 2022. The International Application was published in German on Jan. 4, 2024 as WO/2024/002729 A1 under PCT Article 21(2).

FIELD

The invention relates to a cutlery rack for a dishwasher, comprising a rack body, which is mounted such that it can be pulled out of a washing chamber of the dishwasher in a pull-out direction and which provides a cutlery insert for receiving pieces of cutlery, wherein the cutlery insert has, for separately holding pieces of cutlery oriented transversely to the pull-out direction, a first stud row and a second stud row, which runs parallel to and is spaced apart from the first stud row; each stud row has a plurality of studs disposed one behind the other in the pull-out direction; in each stud row, adjacent studs are mutually spaced apart such that, in each case, an intermediate space is formed.

BACKGROUND

Generic cutlery racks are well known from the prior art, and therefore there is no need for separate substantiating documents at this point. Therefore, reference is also made only by way of example to EP 3409 182 A1 and EP 3 025 628 A1, which each disclose generic cutlery racks.

A generic cutlery rack has a frame-like rack body that provides one or more cutlery inserts for receiving pieces of cutlery. The rack body, together with the cutlery insert(s) received therein, is designed to be movable in the pull-out direction out of or into the washing chamber of the dishwasher.

Studs arranged in rows are provided for separately holding pieces of cutlery, with adjacent studs being mutually spaced apart such that an intermediate space is formed. When used as intended, the intermediate space formed between two adjacent studs holds a piece of cutlery in portions. For the secure positioning of a large number of pieces of cutlery, two stud rows are preferably provided, which are disposed next to one another transversely to the pull-out direction of the cutlery rack, wherein the studs of one stud row extend one behind the other in the pull-out direction.

The previously known construction allows the user to easily load the cutlery rack with individual pieces of cutlery. The pieces of cutlery are disposed between two adjacent studs of a stud row and are oriented transversely, preferably orthogonally to the pull-out direction of the cutlery rack.

Although the above-described design has proven successful in everyday practice, it is not free of disadvantages. In particular, it has been shown that the placement of larger pieces of cutlery is only permitted to an insufficient degree of positional security. This problem occurs in particular with pieces of cutlery which, due to their geometric design, cannot be held, or cannot be securely positioned, in an intermediate space formed between adjacent studs. Such a piece of cutlery must then be positioned within the cutlery insert in the pull-out direction, which hinders the actually desired transverse orientation of other pieces of cutlery, which disadvantageously leads to only limited use of the total space provided by the cutlery insert. The load capacity of the cutlery rack is therefore not used.

SUMMARY

In an embodiment, the present invention provides a cutlery rack for a dishwasher, comprising: a rack body, which is mounted such that the rack body is pullable out of a washing chamber of the dishwasher in a pull-out direction and which provides a cutlery insert for receiving pieces of cutlery, the cutlery insert having, for separately holding pieces of cutlery oriented transversely to the pull-out direction, a first stud row and a second stud row, which runs parallel to and is spaced apart from the first stud row, each stud row having a plurality of studs disposed one behind another in the pull-out direction, and in each stud row, adjacent studs are mutually spaced apart such that, in each case, an intermediate space is formed, wherein two adjacent studs of the first stud row and two adjacent studs of the second stud row are provided by a common support element, and wherein the support element is disposed on the cutlery insert such that the support element is rotatable by at least 90° about an axis of rotation running perpendicularly to the pull-out direction.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
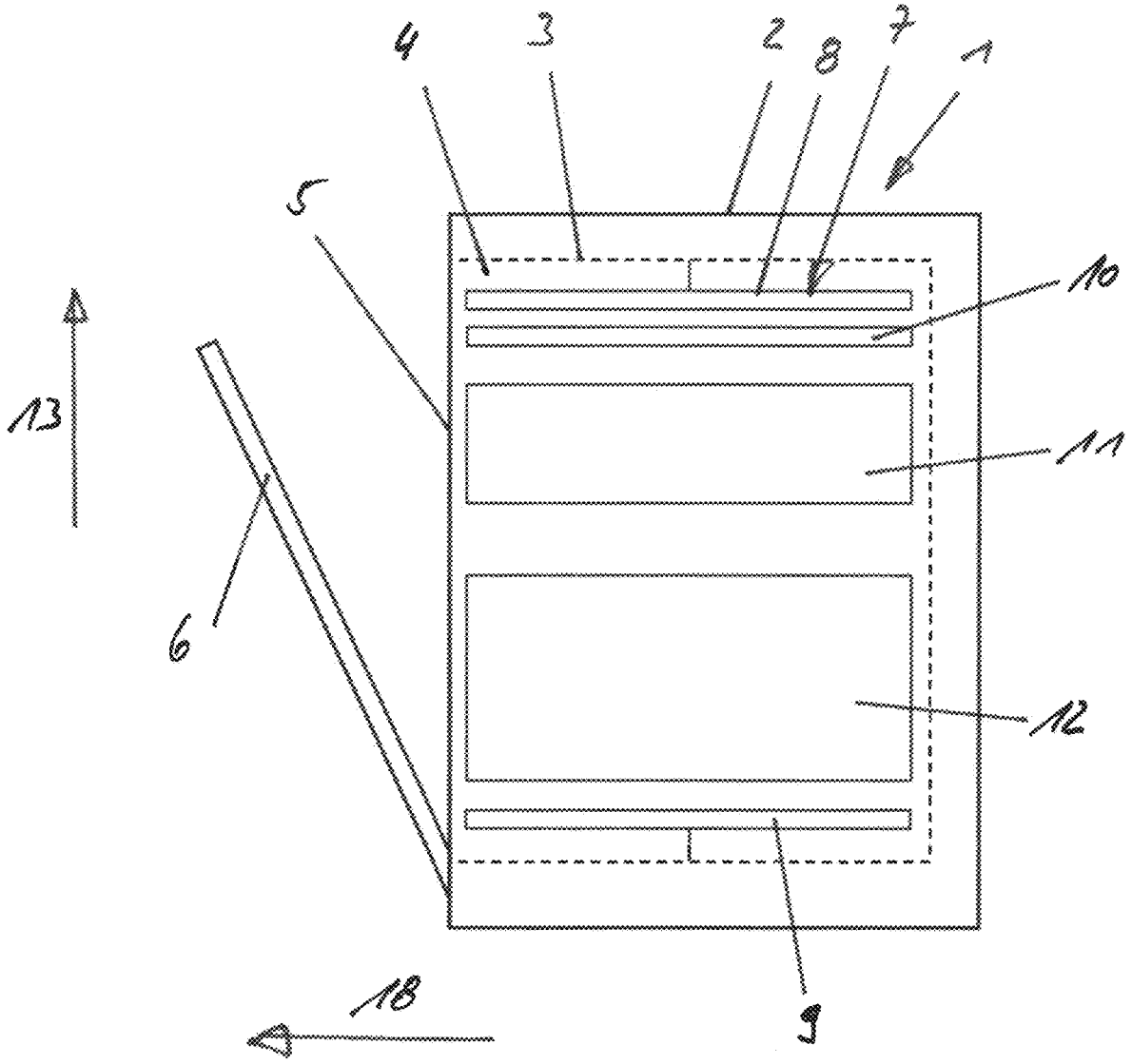
FIG. 1 shows a purely schematic side view of a dishwasher according to the invention.

In an embodiment, the present invention further develops the design of a cutlery rack of this type in such a way that the user can easily make optimal use of the load capacity provided by the cutlery rack.

In an embodiment, the present invention provides a cutlery rack of the type mentioned at the outset, which is characterized in that two adjacent studs of the first stud row and two adjacent studs of the second stud row are provided by a common support element, wherein the support element is disposed on the cutlery insert such that the support element can be rotated by at least 90° about an axis of rotation running perpendicularly to the pull-out direction.

The cutlery rack according to the invention has a support element which supports adjacent studs of the two stud rows, i.e., at least two adjacent studs of the first stud row and at least two adjacent studs of the second stud row. Preferably, the support element has 2 to 10, in particular 4 to 8 studs of the first and second stud rows. The support element can be rotated by the user by at least 90° about an axis of rotation running perpendicularly to the pull-out direction, in particular perpendicularly to the receiving plane of the cutlery insert. It is therefore permitted to position the studs provided by the support element in relation to the other studs of the two stud rows, in particular transversely, which allows a gap to be formed in the stud rows. These gaps in the stud rows, which form when the support element is rotated, can be used to hold larger pieces of cutlery, oriented transversely to the pull-out direction of the cutlery rack. This allows the cutlery load capacity provided by the cutlery rack to be used in an optimized manner. In particular, in contrast to the prior art, it is not necessary to orientate larger pieces of cutlery in the pull-out direction and thus hinder the placement of further pieces of cutlery transversely to the pull-out direction.

As a result, the design according to the invention allows for more flexible loading of the cutlery rack, with pieces of cutlery with a conventional geometric design being positioned transversely to the pull-out direction in the usual way. For larger pieces of cutlery that are too large for the receiving spaces formed between adjacent studs, the support element provided according to the invention can be rotated so that gaps are created in the stud rows as described above, which makes it possible to accommodate larger pieces of cutlery there.

According to a further feature of the invention, it is provided that the support element has a bearing pin which engages in a counter contour on the cutlery insert side. By means of this bearing pin, the support element is disposed on the cutlery insert so that it can rotate. The axis of rotation is created in accordance with the design of the bearing pin transversely to the pull-out direction, i.e., in the vertical direction of the dishwasher. In the final assembled state, the bearing pin interacts with a counter contour on the cutlery insert side, which allows a secure rotational movement of the support element when used as intended.

According to a further feature of the invention, it is provided that the support element has a latching device which is designed to secure the support element in position on the cutlery insert in the direction of the axis of rotation. The latching device provided according to the invention ensures that the support element is positioned precisely and securely on the cutlery insert, in the direction of the axis of rotation, i.e., in the vertical direction of the dishwasher. This ensures that the support element is positioned on the cutlery insert in a captive manner when used as intended, so that the support element cannot accidentally come loose from the cutlery insert. This ensures that the cutlery rack, including the support element disposed thereon, can be handled safely.

According to a further feature of the invention, it is provided that the support element has a locking device which is designed to secure the support element in position on the cutlery insert in the direction of rotation. The locking device provided according to the invention ensures that an unwanted rotational movement of the support element in the direction of rotation is prevented. The locking device secures the support element in the position specified by the user in relation to the cutlery insert. The locking can be carried out continuously, but also in stages, whereby according to the invention it is preferred to provide at least two rotational positions. In the first rotational position of the support element, the studs provided by the support element are oriented in the direction of the stud rows of the cutlery insert, so that closed stud rows are provided. In this position, the cutlery rack can be loaded in the usual way. In a second position of the support element, it is rotated by 90° from the starting position, in which the studs provided by the support element are oriented transversely to the pull-out direction. In this position, the stud rows are interrupted due to the rotated support element and the resulting gaps. The gaps thus formed in the stud rows can be used to hold larger pieces of cutlery in the manner already described. In both of the above-described rotational positions of the support element in relation to the cutlery insert, the locking device according to the invention preferably locks the support element relative to the cutlery insert, so that unintentional rotation of the support element in both possible positions is prevented.

In combination, the latching device on the one hand and the locking device on the other ensure that the support element as a whole is positioned precisely and securely on the cutlery insert, in all possible rotational positions as intended.

According to a further feature of the invention, it is provided that the support element has an annular body which, on the cutlery insert side, carries a plurality of bearing pins evenly distributed over the circumference of a circular ring or the annular body.

According to this particularly preferred embodiment, the support element has not only one bearing pin, but multiple bearing pins, preferably four bearing pins. These bearing pins are arranged on an annular body of the support element. In this case, the annular body itself can, for example, be designed in a ring-like manner, in particular rotationally symmetrical to the axis of rotation of the support element, and the bearing pins can be evenly distributed over the circumference of the annular body. However, the annular body can also have a different geometry, i.e., it may not be ring-shaped itself, as long as the bearing pins it carries are evenly distributed over the circumference of a circular ring that is perpendicular to the axis of rotation of the support element. This ensures that the support element is guided securely relative to the cutlery insert and also allows evenly distributed application of force, which simplifies proper handling. Furthermore, this preferred embodiment ensures simplified assembly and disassembly in the event of repairs.

According to a further feature of the invention, it is provided that each bearing pin is designed to be resiliently pivotable in the radial direction of the annular body and, remote from the annular body, has a latching extension extending in the radial direction of the annular body, for example outwards.

The bearing pins are designed to be resiliently pivotable in the radial direction of the annular body. This allows simplified assembly in particular because the bearing pins pivot to the side when a support element is inserted into the counter contour of the cutlery insert as intended and are returned to their starting position when the annular body reaches its end position. In this end position, the latching extensions provided on the bearing pin side engage behind the counter contour of the cutlery insert, so that a latching of the support element on the cutlery insert in the direction of the axis of rotation is ensured in the manner already described. In the final assembled state, the counter contour on the cutlery insert side is positioned for each bearing pin between the annular body on the one hand and the latching extension on the other. This ensures that the support element is positioned securely on the cutlery insert, but can also be easily removed without tools.

According to a further feature of the invention, it is provided that the cutlery insert has a support ring which interacts with the annular body of the support element and against which the bearing pins of the support element rest on the inner circumference in the final assembled state.

According to this preferred embodiment, the counter contour for the support element on the cutlery insert side is formed by a support ring. In the final assembled state, the annular body of the support element rests on this support ring, with the bearing pins arranged on the annular body engaging behind it with the locking extensions on the bearing pin side. On the one hand, the support ring serves to ensure that the support element is positioned securely, but it also provides the running surface on which the annular body of the support element is guided in the event of intended rotation.

According to a further feature of the invention, it is provided that the support ring has a locking groove on the inner circumference. This locking groove is part of the locking device according to the invention and serves to secure the support element in the direction of rotation in relation to the cutlery insert.

According to a further feature of the invention, it is provided that the support element has a locking extension that interacts with the locking groove of the support ring. The locking extension is also part of the locking device according to the invention, which interacts with the locking groove of the support ring when used as intended. When the support element is in a locked position, the locking extension of the support element engages in the associated locking groove of the support ring. This ensures that the position is secured in the direction of rotation.

According to a further feature of the invention, it is provided that the support element has two longitudinal webs arranged on the annular body, wherein one longitudinal web carries the two studs of the first stud row and the other longitudinal web carries the two studs of the second stud row. In the non-rotated basic position, the longitudinal webs extend in the direction of the two stud rows on the cutlery insert side. As a result, the studs carried by the longitudinal webs are oriented in the stud row, which allows the stud rows to be used in the conventional manner.

According to a further feature of the invention, the support element has two transverse webs disposed on the annular body and connecting the two longitudinal webs to one another. The result is a rectangular design or arrangement of the longitudinal webs on the one hand and the transverse webs on the other. The webs surround the annular body, which serves to rotatably support the support element in the manner described above. The result is a very simple construction of the support element, which on the one hand ensures a robust arrangement of the studs, and on the other hand allows the possibility of the previously described rotational movement of the support element.

According to a further feature of the invention, it is provided that a transverse web carries a separating means on its side facing the studs. Such a separating means can serve to provide additional support for a piece of cutlery received by the support element when used as intended. The provision of such a separating means is optional. The cross-member can also be designed without any separating means. It is, however, preferred to provide a separating means because this ensures that a held piece of cutlery takes up a defined position. This achieves an optimized cleaning result when used as intended. A separating means can be used, for example, to divide the otherwise free side of a cross-member into two individual receiving portions, so that contact surfaces, e.g., inclined contact surfaces for a piece of cutlery to be supported, are provided on both sides of the separating means. The separating means can also be arranged off-center on the cross-member, so that two receiving portions of different sizes are provided.

The invention further proposes a dishwasher with a cutlery rack according to the invention. A dishwasher equipped in this way offers the advantages already mentioned above.

FIG. 1 shows, in a purely schematic side view, a dishwasher 1 according to the invention. This has a housing 2 in a manner known per se, which accommodates a washing container 3. The washing container 3 in turn provides a washing chamber 4 for receiving washware to be cleaned.

The washing chamber 4 is accessible via a loading opening 5. Said loading opening can be closed in a fluid-tight manner by means of a washing chamber door 6 which is pivotably disposed on the housing 2.

The dishwasher 1 is provided with a spraying device 7 for supplying the washware to be cleaned with washing liquid. This spraying device 7 has a plurality of rotatably disposed spray arms, whereby in the embodiment shown two spray arms 8 and 9 are shown.

Washware carriers are used to hold the washware to be cleaned, with a cutlery rack 10, an upper basket 11 and a lower basket 12 being provided in the embodiment shown. The upper basket 11 is arranged above the lower basket 12 in the vertical direction 13 and the cutlery rack 10 is located above the upper basket 11 in the vertical direction 13.

In order to load the cutlery rack 10, the upper basket 11 or the lower basket 12 with washware, these can be moved out of the washing chamber 4 of the dishwasher 1 in the pull-out direction 18 by the user. For this purpose, the cutlery rack 10, the upper basket 11 and the lower basket 12 are mounted so that they can be pulled out of the washing chamber 4 of the dishwasher 1 in the pull-out direction 18.

The cutlery rack 10 is designed in accordance with the invention, as can be seen from FIGS. 2 to 11.

Figure 2:
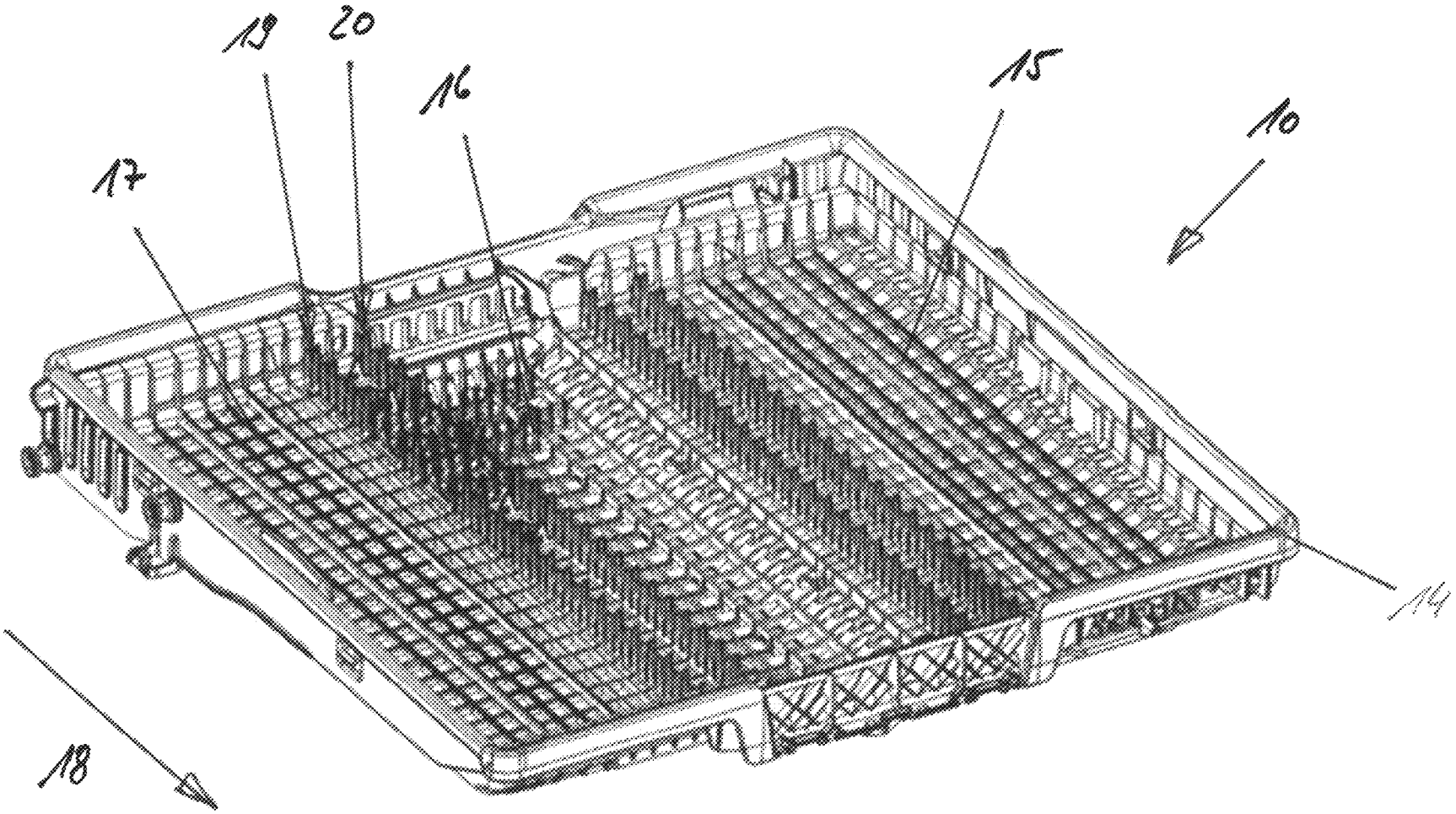
FIG. 2 shows a schematic perspective view of a cutlery rack according to the invention.

FIG. 2 first shows that the cutlery rack 10 has a rack body 14 which is designed in the manner of a frame. This rack body 14 carries a total of three cutlery inserts 15, 16 and 17, wherein one cutlery insert 16 is disposed transversely to the pull-out direction 18 between two cutlery inserts 15 and 17.

The two cutlery inserts 15 and 17 each have stud rows running in the pull-out direction 18, namely a first stud row 19 and a second stud row 20, as shown by way of example using the cutlery insert 17 in FIG. 2. Each stud row 19 and 20 has studs 21 and 22 which are disposed one behind the other in the pull-out direction 18, with an intermediate space 23 being formed between adjacent studs 21 and 22.

Figure 8:
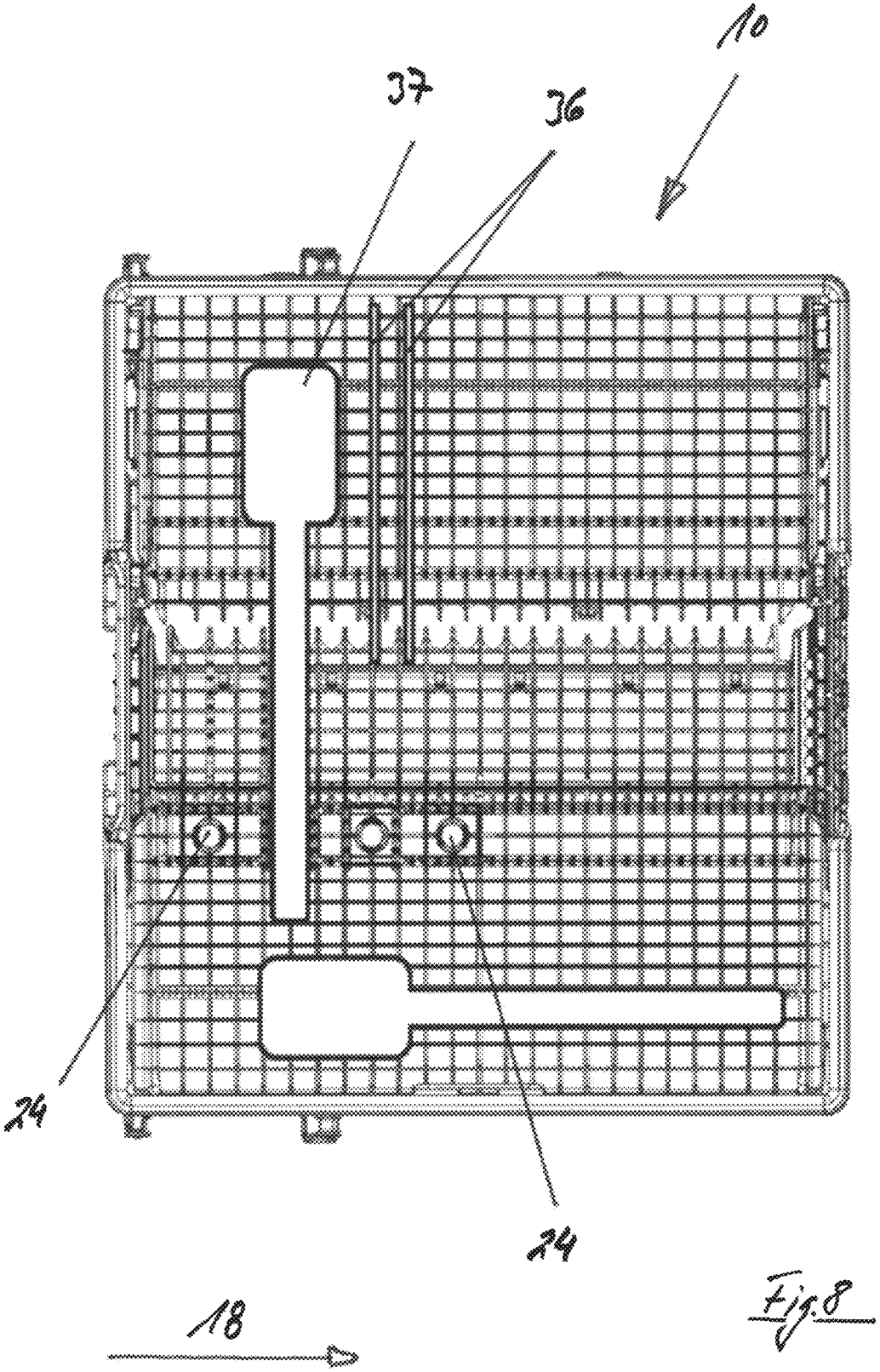
FIG. 8 shows a schematic plan view from above of the cutlery rack according to the invention.
Figure 9:
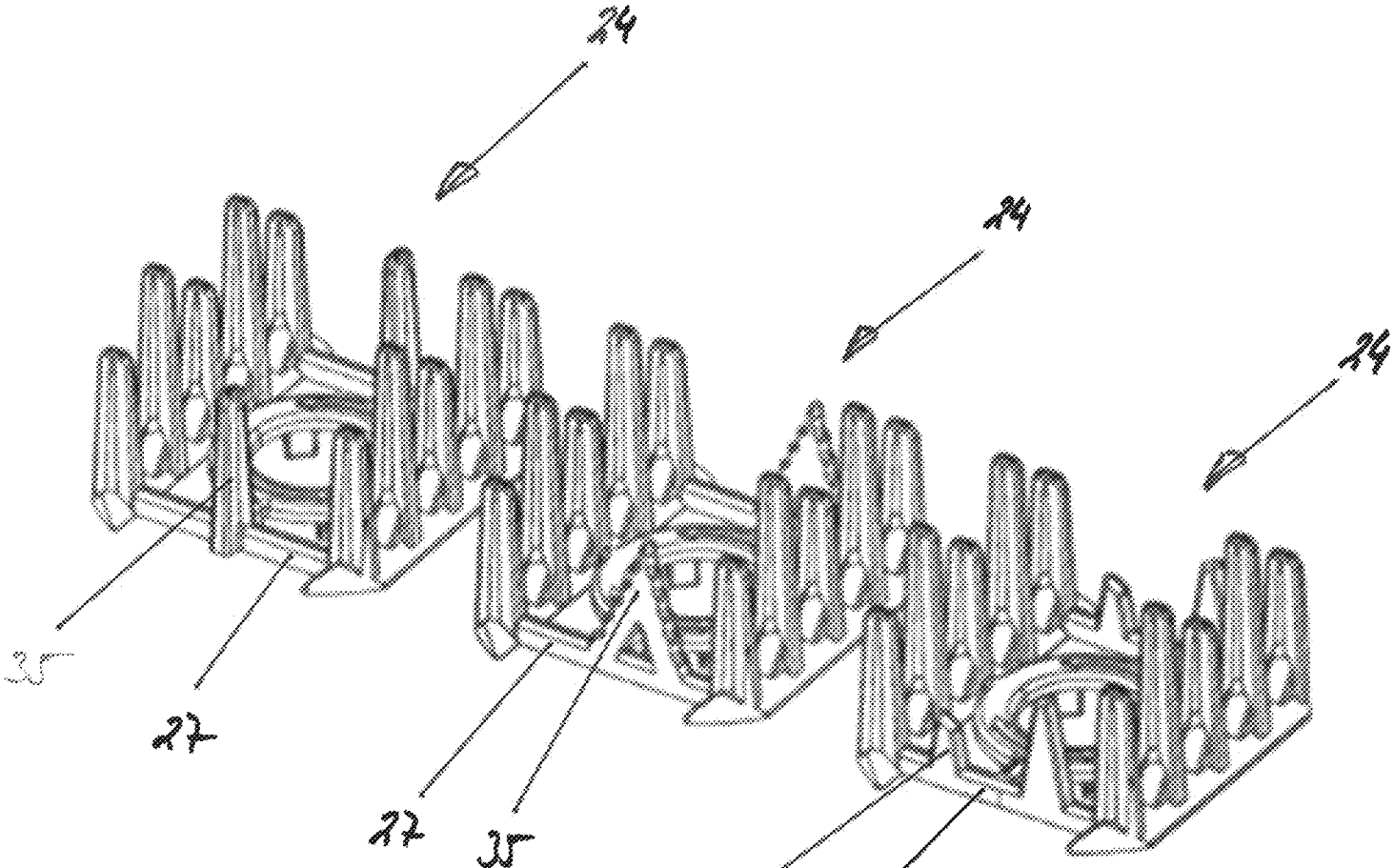
FIG. 9 shows a schematic perspective view of three embodiments of a support element according to the invention.
Figure 10:
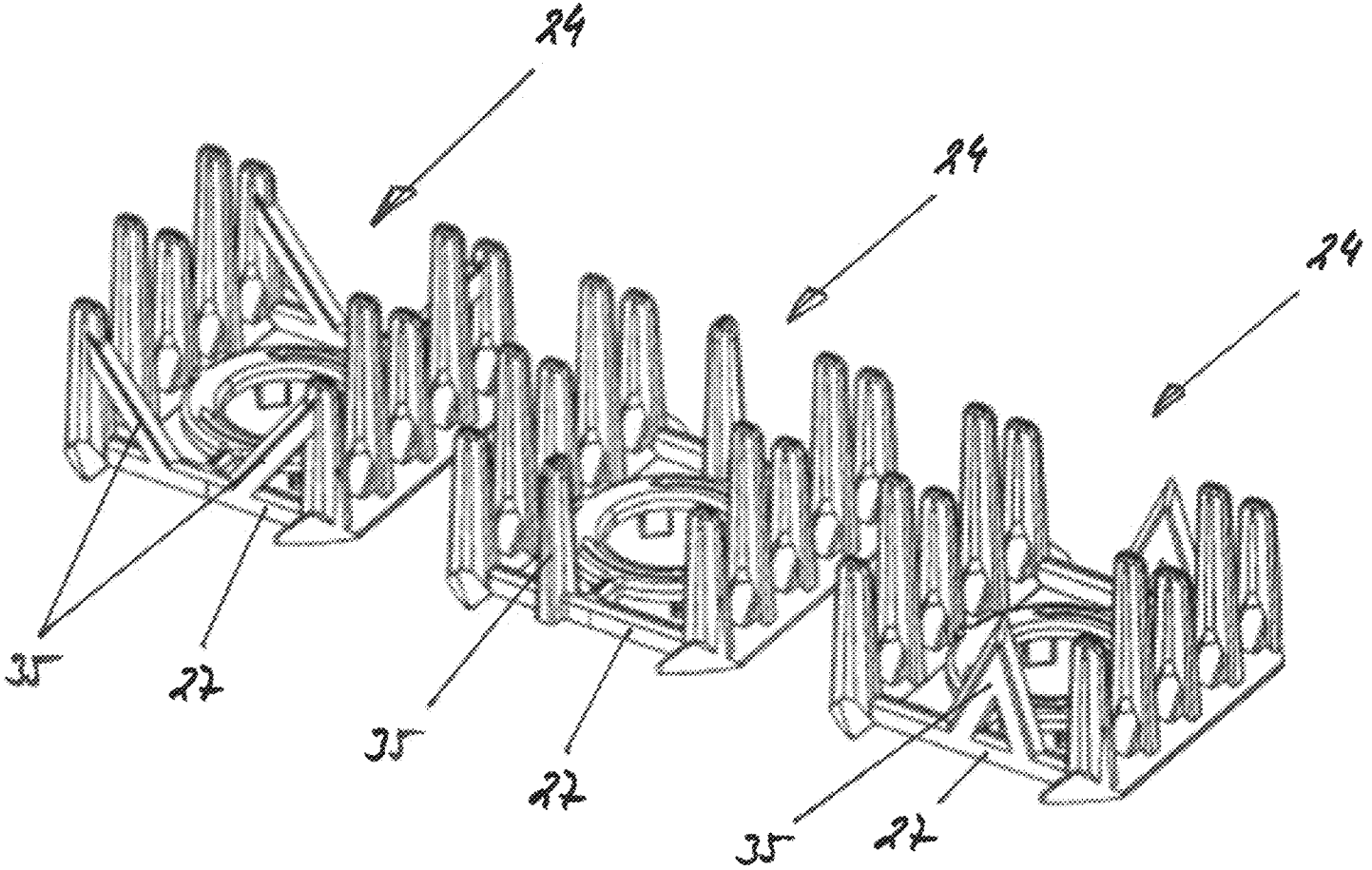
FIG. 10 shows a schematic perspective view of three further embodiments of the support element according to the invention.

The stud rows 19 and 20 serve in a manner known per se to separately hold pieces of cutlery, namely oriented transversely to the pull-out direction, as can be seen in FIG. 8 with knives 36 as pieces of cutlery.

Figure 3:
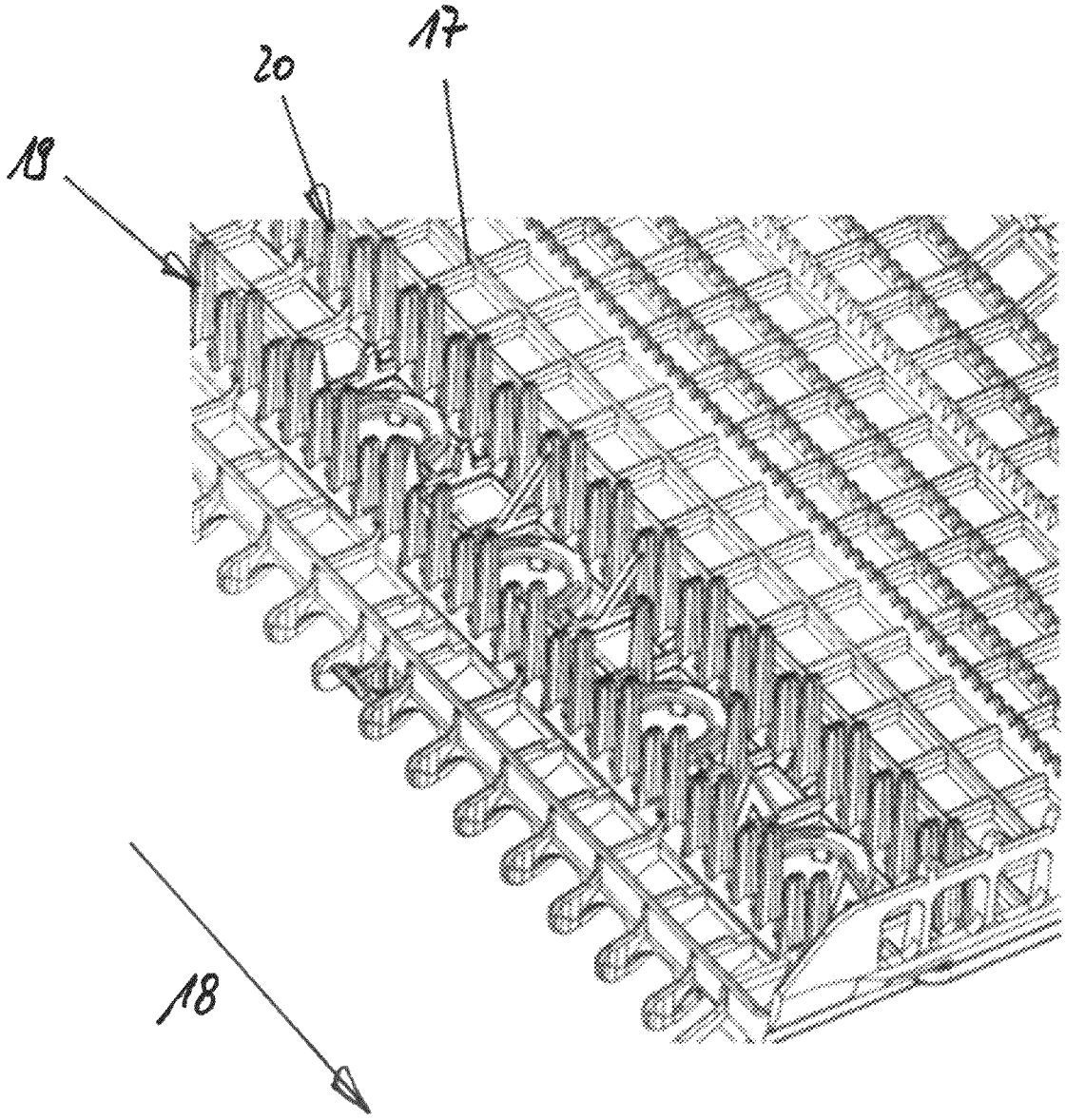
FIG. 3 shows a schematic perspective view of a section of the cutlery rack according to FIG. 2.
Figure 4:
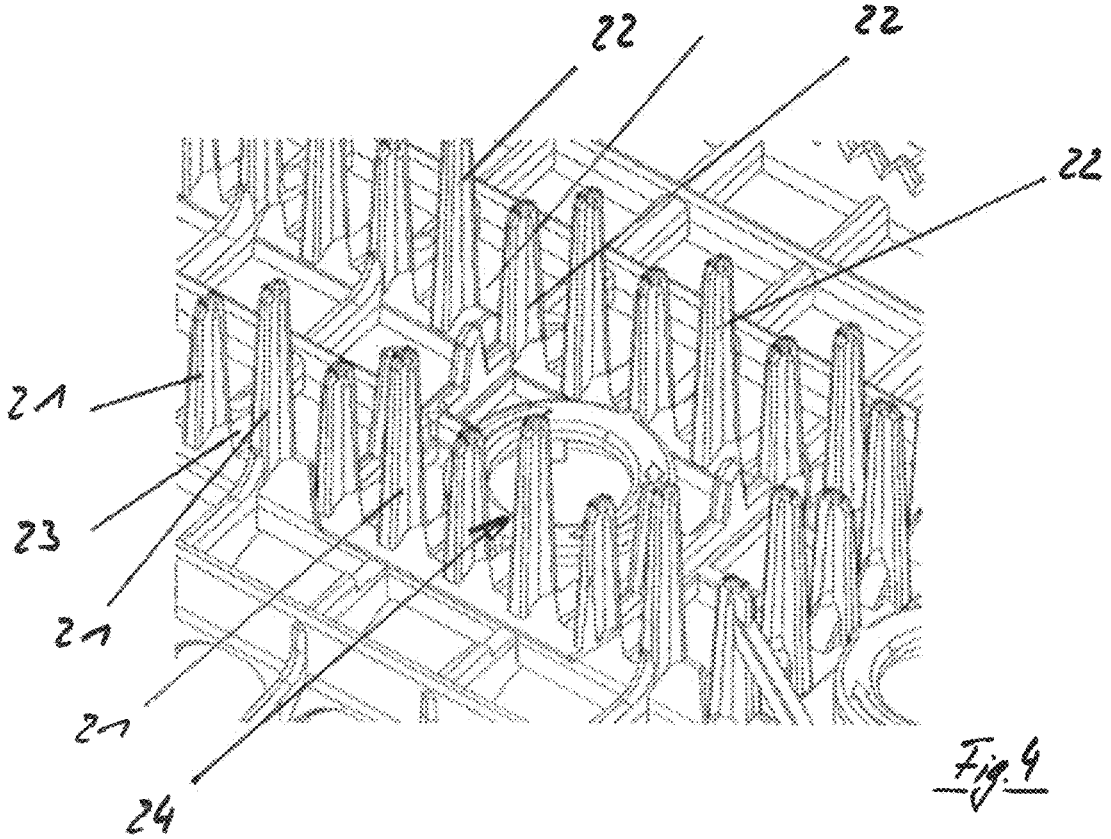
FIG. 4 shows a detailed view of the cutlery rack according to FIG. 2.
Figure 5:
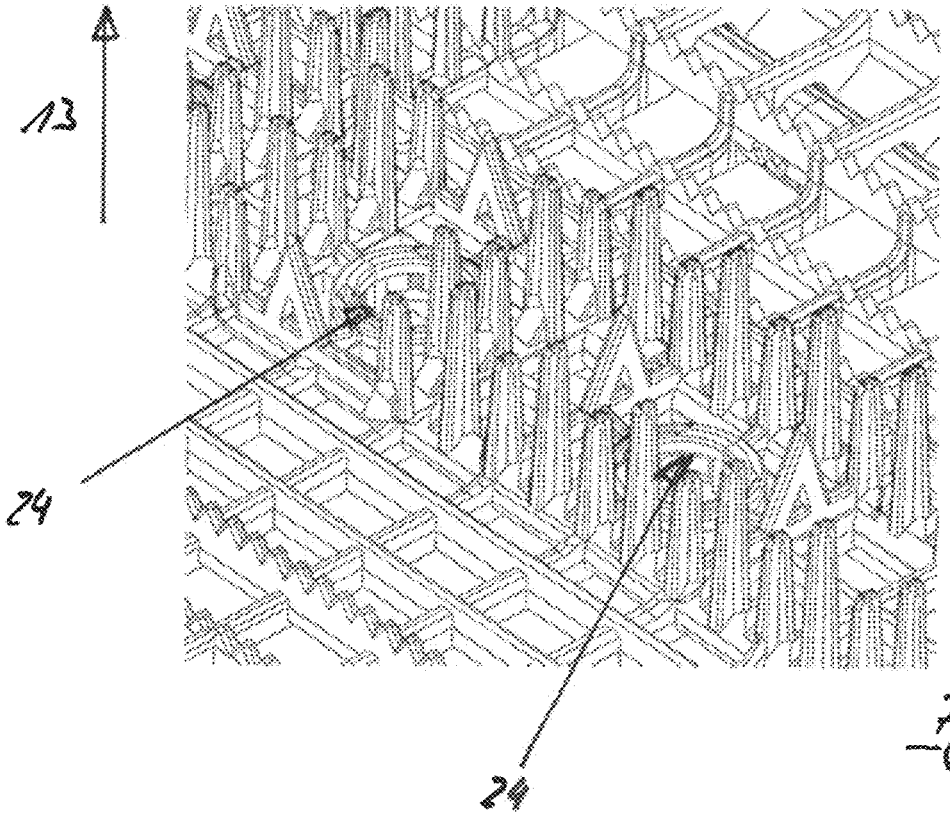
FIG. 5 shows a further detailed view of the cutlery rack according to FIG. 2.

According to the invention, it is provided that at least two (in the embodiment shown there are only five by way of example) adjacent studs 21 of the first stud row 19 and at least two (in the exemplary embodiment shown there are only five by way of example) adjacent studs 22 of the second stud row 20 are provided by a common support element 24, as can be seen from a comparison of the detailed views according to FIGS. 3 and 4. In this case, a support element 24 is disposed on the cutlery insert 17 so that the support element can be rotated by 90° about an axis of rotation running perpendicularly to the pull-out direction 18, in particular perpendicularly to the receiving plane of the cutlery insert 17. This factual connection can be seen in FIG. 5, wherein the right-hand support element 24 in FIG. 5 is in the normal position, whereas the left-hand support element 24 in FIG. 5 is rotated by 90° in relation to the cutlery insert 17.

Figure 6:
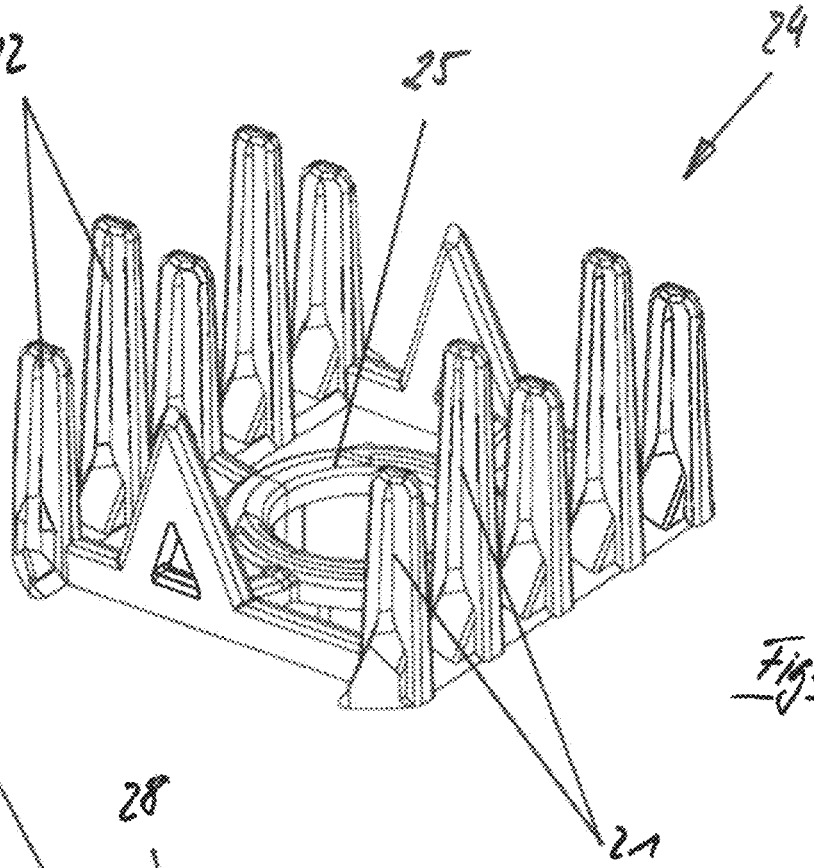
FIG. 6 shows a schematic perspective view of a support element according to the invention.
Figure 7:
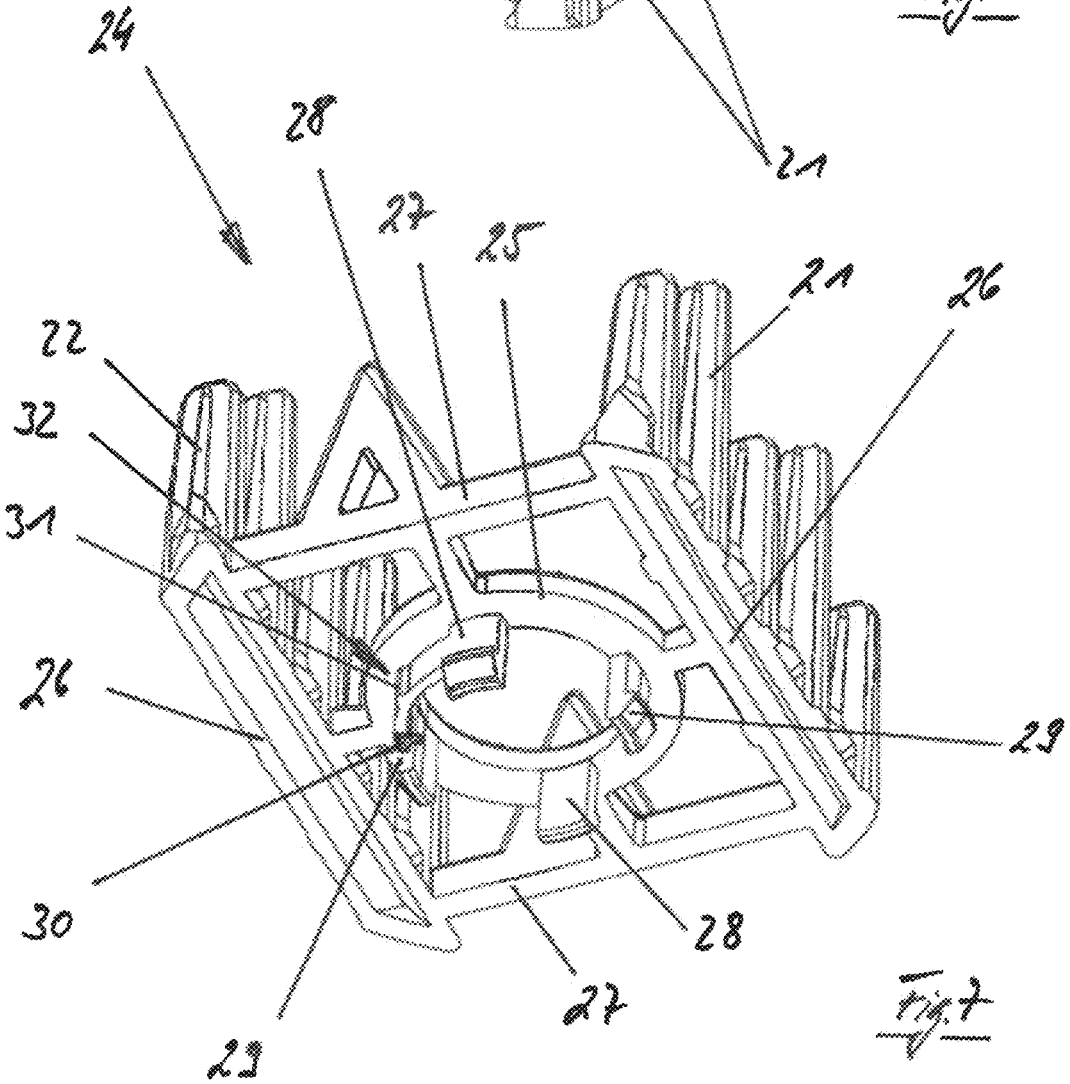
FIG. 7 shows a schematic perspective view from below of the support element according to FIG. 6.

The design of the support element results in particular from a comparison of FIGS. 6 and 7. As can be seen from these illustrations, a support element 24 has an annular body 25. In the embodiment shown, this annular body 25 carries four bearing pins 28 which extend downwards from the annular body 25 in relation to the vertical direction 13. The bearing pins 28 are disposed on the annular body 25 so as to be resiliently pivotable in the radial direction of the annular body.

Each bearing pin 28 has a latching extension 29 which is remote from the annular body and extends outwards in the radial direction of the annular body 25. In the final assembled state, the annular body 25 and the bearing pins 28 disposed thereon rest against a corresponding counter contour of the cutlery insert 17.

Figure 11:
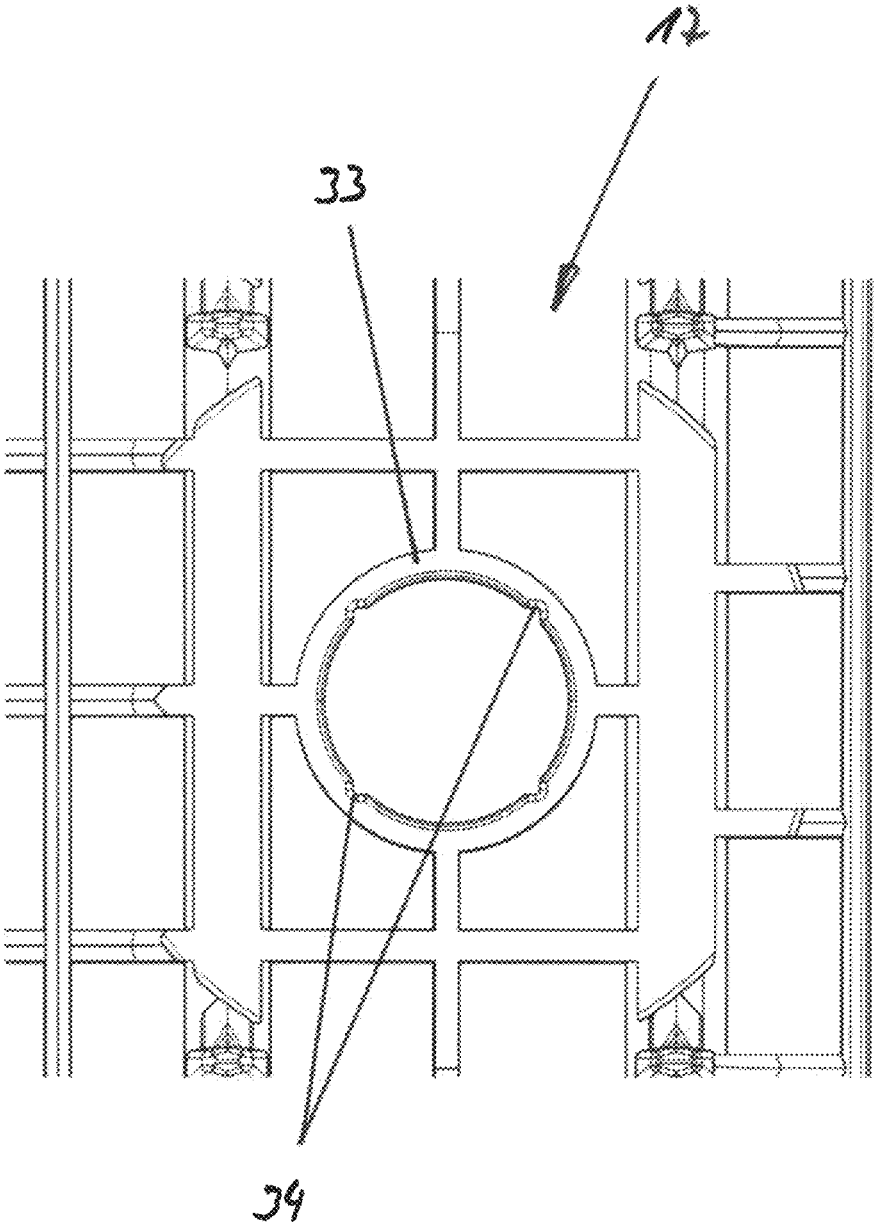
FIG. 11 shows a schematic plan view from above of a section of a cutlery rack according to the invention.

This counter contour of the cutlery insert 17 is formed by a support ring 33, as can be seen in FIG. 11 from a plan view of the cutlery insert 17. In the final assembled state, the annular body 25 of a support element 24 rests on the associated support ring 33 of the cutlery insert 17. The bearing pins 28 rest on the inner circumference of the support ring 33, with the latching extensions 29 on the bearing pin side engaging under the support ring 33. Thus, in the final assembled state, the support ring 33 is arranged between the annular body 25 of a support element 24 and the latching extensions 29 of the associated bearing pins 28. This ensures that the support element 24 is securely latched onto the cutlery insert 17, with the support element 24 being positioned on the cutlery insert 17 in the direction of the axis of rotation.

As can be seen from a comparison of FIGS. 6 and 7, a support element 24 also has longitudinal webs 26 and transverse webs 27. The longitudinal webs 26 and transverse webs 27 are disposed on the annular body 25, in the embodiment shown with the interposition of spacer webs. The transverse webs 27 connect the longitudinal webs 26 to one another in such a way that a rectangular configuration is achieved with regard to the longitudinal webs 26 on the one hand and the transverse webs 27 on the other.

In the embodiment shown, the longitudinal webs 26 carry the studs 21 and 22 provided by the support element 24 on the upper side. The cross-members 27 are optionally equipped with a separating means 35.

A locking device 33 is provided to secure the position of the support element 24 in the direction of rotation. In the embodiment shown, this has a locking extension 31 on the support element side and a locking groove 34 on the cutlery insert side, as can be seen in particular from a comparison of FIGS. 7 and 11. Depending on the rotational position of the support element 24, the locking extension 31 interacts with one of the four locking grooves 34. In the locked state, the locking extension 31 engages in the associated locking groove 34, thus preventing an unwanted rotational movement of the support element 24 in relation to the cutlery insert 17.

A support element 24 can be rotated in relation to the cutlery insert 17, as can be seen from the previously explained FIG. 5. The support element 24 can be transferred from a normal position to a rotated position and vice versa. In the normal position of the support element 24, the stud rows can be equipped with pieces of cutlery in a conventional manner, the pieces of cutlery in this case being oriented transversely to the pull-out direction 18, as can be seen from the knives 36 in FIG. 8.

In the rotated position of the support element 24, the studs 21 and 22 provided by the support element 24 are oriented transversely to the stud rows 19 and 20, thus transversely to the pull-out direction 18. In this position of the support element 24, the two stud rows 19 and 20 are interrupted in the region of the support element 24, whereby the stud rows 19 and 20 have corresponding gaps. This allows larger pieces of cutlery to be held, as shown by a kitchen spoon 37 in FIG. 8.

In order to ensure positioning of even larger pieces of cutlery in a rotated position of a support element 24, a support element 24 can optionally be equipped with a separating means 35 as already described above. Different embodiments are conceivable with regard to an optional separating means 35, as shown by a comparison of FIGS. 9 and 10 based on different embodiments. In this case, a separating means 35 basically serves to divide the otherwise free side of a cross-member into individual receiving portions, so that contact surfaces are provided for a piece of cutlery 37 to be supported.

As can be seen from the above description, the design according to the invention allows a more flexible and space-optimized loading of the cutlery rack 10. This is because the rotatable arrangement of the support elements 24 according to the invention makes it possible to optionally place larger pieces of cutlery in the cutlery rack 10 transversely to the pull-out direction 18, so that an orientation of a larger piece of cutlery in the pull-out direction 18 as shown by way of example in FIG. 8 is not necessary. This advantageously means that the transverse orientation of other pieces of cutlery is not hindered, so that the load capacity provided by the cutlery rack 10 can also be used optimally in the intended manner.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SIGNS

1 Dishwasher
2 Housing
3 Washing container
4 Washing chamber
5 Loading opening
6 Washing chamber door
7 Spraying device
8 Spray arm
9 Spray arm
10 Cutlery rack
11 Upper basket
12 Lower basket
13 Vertical direction
14 Rack body
15 Cutlery insert
16 Cutlery insert
17 Cutlery insert
18 Pull-out direction
19 First stud row
20 Second stud row
21 Studs
22 Studs
23 Intermediate space
24 Support element
25 Annular body
26 Longitudinal web
27 Cross-member
28 Bearing pins
29 Latching extension
30 Latching device
31 Locking extension
32 Locking device
33 Support ring
34 Locking groove
35 Separating means
36 Knife
37 Kitchen spoon

The invention claimed is:

1. A cutlery rack for a dishwasher, comprising:

a rack body, which is mounted such that the rack body is pullable out of a washing chamber of the dishwasher in a pull-out direction and which provides a cutlery insert for receiving pieces of cutlery, the cutlery insert having, for separately holding pieces of cutlery oriented transversely to the pull-out direction, a first stud row and a second stud row, which runs parallel to and is spaced apart from the first stud row; each stud row having a plurality of studs disposed one behind another in the pull-out direction, and in each stud row, adjacent studs are mutually spaced apart such that, in each case, an intermediate space is formed, wherein two adjacent studs of the first stud row and two adjacent studs of the second stud row are provided by a common support element; and wherein the support element is disposed on the cutlery insert such that the support element is rotatable by at least 90° about an axis of rotation running perpendicularly to the pull-out direction.

2. The cutlery rack of claim 1, wherein the support element has a bearing pin which engages in a counter contour on a cutlery insert side.

3. The cutlery rack of claim 1, wherein the support element has a latching device configured to secure the support element in position on the cutlery insert in a direction of the axis of rotation.

4. The cutlery rack of claim 1, wherein the support element has a locking device configured to secure the support element on the cutlery insert in the direction of rotation.

5. The cutlery rack of claim 2, wherein the support element has an annular body which, on a cutlery insert side, carries a plurality of bearing pins evenly distributed over a circumference of the annular body.

6. The cutlery rack of claim 5, wherein each bearing pin is resiliently pivotable in a radial direction of the annular body and, remote from the annular body, has a latching extension extending in the radial direction of the annular body, in particular outwards.

7. The cutlery rack of claim 5, wherein the cutlery insert has a support ring which interacts with the annular body of the support element and against which the bearing pins of the support element rest on an inner circumference in a final assembled state.

8. The cutlery rack of claim 7, wherein the support ring has a locking groove on an inner circumference thereof.

9. The cutlery rack of claim 8, wherein the support element has a locking extension which interacts with the locking groove of the support ring.

10. The cutlery rack of claim 5, wherein the support element has two longitudinal webs arranged on the annular body, and wherein one longitudinal web carries the two studs of the first stud row and the other longitudinal web carries the two studs of the second stud row.

11. The cutlery rack of claim 10, wherein the support element has two transverse webs disposed on the annular body and connecting the two longitudinal webs to one another.

12. The cutlery rack of claim 11, wherein a transverse web carries a separating means on a side facing the studs.

13. A dishwasher, comprising:

the cutlery rack of claim 1.

* * * * *